United States Patent [19]

Möbius

[11] 4,388,768

[45] Jun. 21, 1983

[54] STIFFENING AND NON-SLIP MATERIAL FOR THE HEEL REGION OF SHOES

[75] Inventor: Olaf Möbius, Rodenbach, Fed. Rep. of Germany

[73] Assignee: Degussa AG, Frankfurt, Fed. Rep. of Germany

[21] Appl. No.: 250,722

[22] Filed: Apr. 3, 1981

Related U.S. Application Data

[62] Division of Ser. No. 52,306, Jun. 26, 1979, Pat. No. 4,308,763.

[30] Foreign Application Priority Data

Jun. 29, 1978 [DE] Fed. Rep. of Germany ..... 2828509
Jun. 29, 1978 [DE] Fed. Rep. of Germany ... 7819462[U]

[51] Int. Cl.[3] ..... A43B 13/42; A43D 21/00
[52] U.S. Cl. ..... 36/68; 12/146 D
[58] Field of Search ..... 36/68, 69, 77 M; 12/146 D

[56] References Cited

U.S. PATENT DOCUMENTS

| | | | |
|---|---|---|---|
| 2,067,239 | 1/1937 | Mayo et al. | 36/68 |
| 2,648,616 | 8/1953 | Gauthier | 36/77 M |
| 3,174,236 | 3/1965 | Field | 12/146 D |
| 3,238,089 | 3/1966 | Griswold | 36/68 X |
| 3,778,251 | 12/1973 | Trask | 36/68 X |
| 4,069,602 | 1/1978 | Kremer et al. | 12/146 D |
| 4,308,673 | 1/1982 | Mobius | 36/68 |

FOREIGN PATENT DOCUMENTS

| | | | |
|---|---|---|---|
| 238600 | 5/1962 | Australia | 36/68 |
| 793846 | 4/1958 | United Kingdom | 12/146 D |
| 1083849 | 9/1967 | United Kingdom | 36/77 M |

*Primary Examiner*—Patrick D. Lawson
*Attorney, Agent, or Firm*—Cushman, Darby & Cushman

[57] ABSTRACT

There are provided thermoplastic or through the action of solvent shapable, shoe stiffening and likewise non-slip inner material for the heel region in the form of continuous sheets or blanks consisting of an embedded fiber structure which is loaded or filled with at least one synthetic resin acting as a stiffening agent at normal temperature up to about 60° C. in an amount of 0.1 to 0.9 kg per square meter fiber structure in the course of which the loading in a given case can contain fillers, dyestuffs, pigments, plasticizers, propellants, stabilizers, processing aids and/or extenders in the customary amounts.

50 Claims, No Drawings

STIFFENING AND NON-SLIP MATERIAL FOR THE HEEL REGION OF SHOES

This is a division of application Ser. No. 52,306, filed June 26, 1979, now U.S. Pat. No. 4,308,763.

BACKGROUND OF THE INVENTION

The invention is directed to a new shoe stiffening and likewise non-slip inner material and to a heel region of customary street shoes having this shoe inner material; it is not concerned for example with light, counterless shoes and/or shoes free of stiffening heel pieces in the heel portion.

The customary street shoes in the heel region consist of at least three shaped layers: First the leg or leg material (also called the upper material), second the stiffening heel piece (cap) or the stiffening material (also designated as rear heel piece material or short heel piece material) and third the slip band or non-slip material. In reciting these layers there are not counted the customary adhesive layers or coats.

SUMMARY OF THE INVENTION

The new inner shoe material serving to stiffen the heel region of street shoes is suitably produced in the form of continuous sheets or lengths and used in blanks (pieces) produced therefrom. It is thermoplastic, i.e. deformable under the action of heat or softenable by the action of solvent. It consists of a single layered fiber structure (thus it is not constructed multiplyed). It is loaded or filled with at least one synthetic resin acting as stiffener at normal temperature (about 15° to 25° C.) up to about 60°, specifically in amounts of 100 to 900 grams per square meter of fiber structure in which the loading set forth in a given case contains additional fillers, dyestuffs, pigments, plasticizers, stabilizers, propellants, processing aids and/or known extenders in each case in customary amounts. The inner material of the shoe advantageously is finely porous and absorbent for water and solvents.

Suitably one of the large surface sides of the shoe inner material continuous length or the blank made therefrom is provided with a coat based on a synthetic resin, preferably a thermoplastic synthetic resin, brought to the adhesive condition by the action of heat or the action of a solvent or mixture of solvents. In order to be able to produce with the new shoe inner material, the effect of the previously used non-slip materials in the production of shoes, this surface has a shape or character which is slip or slide diminishing. The surface of the new material thus has a certain roughness which prevents or makes more difficult the slipping out of the heel. It is particularly advantageous when the side of the new material which comes in contact with the heel or the hose by this procedure maintains a velvet-like character that the surface in question is treated mechanically, for example, by buffing on appropriate known apparatus (buffing rolls).

The above described inner shoe material is worked into the heel portion of the shoe and secured there suitably by gluing. Surprisingly and contrary to the structure of the previous conventional street shoes the new shoe inner material replaces both the function of the stiffening shoe capping material and the function of the non-slip material which should prevent the easy slipping out of the heel from the back part of the shoe, i.e. the inner material can be designated to be skid preventive too. This bifunctionality of the new shoe inner material simplifies the production of shoes in considerable measure and reduces the production costs which is of advantage in the developing countries because of the type of shoes produced there. The previous long time practice in the production of shoes of adding both flexible, pliable non-slip materials and besides that also stiffening effecting capping materials now can be unexpectedly changed by the present invention and be substantially simplified. The invention permits the more economical production of particularly simple footwear.

The consequently produced new heel region of shoe thus no longer has a separate customary heel stiffener and it consists of the accurate last shaped shoe inner material blank of the above described type and of the leg glued therewith.

Accordingly to the invention there is also claimed the process of stiffening the heel portions of shoes which is characterized by fastening by securely sewing or similar method a suitable blank of the new moldable shoe inner material at the upper edge of the inner side of an upper material without a counter to simultaneously stiffen the heel region and produce the non-slip effect. In the case of the insertion of the shoe inner material which is not provided with an adhesive layer the inner side of the blank is provided with an adhesive coating and then the combination worked on the last through the effect of pressure and if desired of heat and thus the cementing is effected.

If the shoe inner material on one side is provided with a dry, thus not adhesive, but activatable adhesive layer and has been cut for use, the above described stiffening process is varied and simplified by softening the shoe inner material blank fastened or securely sewn on the upper by means of a solvent or a mixture of solvents which at the same time brings said layer into the adhesive condition after which the upper and inner material blank are molded together on the shoe last in customary manner during which the adhesion of the two takes place. The solvent or solvent mixture can be applied in simple manner for example with a brush to the side of the inner shoe material not provided with an adhesive whereupon the solvent (or mixture of solvents) gradually penetrates into and through the shoe inner material, it softens and then even activates the adhesive film. Consequently it is possible with the correct selection of the solvent or solvent mixture in sufficient time to mold the softened shoe inner material blank in customary manner together with the upper and at the same time to adhere them. The shoe inner material blank can also be so immersed in the solvent (or mixture of solvents) that practically only the blank and not the upper is wetted by the solvent whereupon the described molding and adhering takes place.

The new shoe inner material has very good tear resistance properties both in the dry and in the wet state and it has a good shape retention even after the influence of moisture. The abrasion resistance as well as the water absorption and release of water, which latter are comparable with the uptake and release of foot perspiration, as well as the stitch tear strength are likewise very good. The new shoe inner material also exhibits a favorable stress-strain ratio as well as small swelling and shrinkage values. All of these valuable properties make the new material especially suited for use as a shoe inner material.

The fiber structures used are cloth, knitted fabrics, non-wovens and preferably fleece made of natural or synthetic fibers such as cotton, wool, rayon staple, rayon and/or synthetic fibers of polyamide (e.g., polycaprolactam or polyhexamethylene-adipamide), polyacrylonitrile, polyvinyl chloride, polyvinylidene chloride, polypropylene and especially polyesters such as, e.g., polyethylene glycol terephthlate (e.g. Dacron). The fiber structure has a square meter weight between 80 and 500 grams, preferably between 150 and 400 grams; as fleece it is 150 to 400 grams.

The synthetic resins acting as stiffening agents which are suited for loading include particularly polymers of styrene and copolymers of styrene and butadiene and also polyvinyl chloride, polyvinyl acetate, polyvinylidene chloride, vinyl chloride-vinyl acetate copolymer and the like known polymers. They are used in such amounts that the loading finally amounts to 0.1 to 0.9 kg, preferably 0.2 to 0.7 kg, per square meter of fiber structure (dry weight without fiber structure weight). The synthetic resins mentioned advantageously also can be used with known natural resins such as rosin or synthetic resins such as ureaformaldehyde or melamine-formaldehyde resins or their precondensates and/or with polyvinyl alcohols, particularly those types of polyvinyl alcohols which are obtained by substantial to complete hydrolysis of a polyvinyl ester, e.g. polyvinyl acetate.

Additionally there can be used for the loading fillers such as kaolin, chalk, talc, clays, silica fillers, siliceous chalk, keiselguhr as well as in a given case titanium dioxide, carbon blacks and other pigments in amounts of about 10 to 200 parts by weight, preferably up to 80 parts by weight based on 100 parts by weight of the synthetic resin. Other auxiliaries which can be present in the loading are dyestuffs, pigments, plasticizer, stabilizers, propellants, processing aids and/or extenders in customary amounts. The mixture provided for the loading, according to its composition, its amounts of constituents and condition, e.g., as dispersion, paste or dough, is so chosen that the loaded or filled as well as dried fiber structure stands or remains at normal temperatures up to 60° C. stiffly-elastic and relatively hard. Therefore there are preferably added as synthetic resins polystyrene and copolymers of styrene and butadiene with styrene contents between about 85 and 60 as well as between about 40 to 20 weight percent, balance butadiene, in amounts of 250 to 600 grams per square meter of fiber structure. With advantage the styrene butadiene copolymers can be so called carboxylated copolymers, thus copolymers with carboxyl groups in the molecule. The loading mixture suitably is a pasty brushable composition.

As solvents which softens the shoe inner material and in a given case the adhesive layer there are employed the customary fast and slow evaporation solvents, volatile organic compounds such as ketones, e.g., acetone, esters, e.g. methyl acetate, ethyl acetate and butyl acetate, volatile hydrocarbons, e.g. gasoline and benzene, alcohols, e.g. methyl alcohol, ethyl alcohol, isopropyl alcohol and n-butyl alcohol, tetrahydrofuran, ethers, e.g. diethyl ether and dibutyl ether and their mixtures, especially methyl propyl ketone, ethyl butyl ketone, methyl isobutyl ketone and methyl-n-butyl ketone, as well as preferably methyl ethyl ketone and diethyl ketone.

The synthetic resin provided for the adhesive layer brought into the adhesive condition by the action of heat or through the action of solvent is preferably a thermoplastic synthetic resin. The adhesive thus is one based on at least one of the following polymers polychlorobutadiene, polyvinyl acetate, polyacrylic acid esters, e.g., polyalkyl acrylates such as poly (methyl acrylate), poly (ethyl acrylate), poly (butyl acrylates), poly (2-ethylhexyl acrylate), nitrile rubber (i.e. butadiene acrylonitrile) or preferably an ethylene-vinyl acetate copolymer. These adhesive bases can, if desired and frequently with advantage, be mixed in with other resins, for example natural resins, e.g. rosin, phenol resins (e.g., phenolformaldehyde resins), maleinate resins, modified colophony resins or the like known resins and in customary proportions.

The adhesive is brushed on in corresponding preparation, e.g. in the mixture with the solvent or as dispersion, on the shoe inner material or on the blank. This can take place mechanically e.g. immediately after the production of the continuous sheet material or the blank can be coated with the adhesive preparation in the production of the shoe. In the latter case the adhesion can be undertaken immediately. If the shoe inner material already has a dry adhesive layer then this material can be activated again as described above with heat or by the effect of solvent.

The loading of the fiber structure is attained by steeping, impregnating or coating, e.g. using a trough containing the loading composition through which the fiber structure is led. The loading can also be carried out as a coating during which the fiber structure rests upon a rubber blanket or there can also be employed a doctor blade conventionally used for coating purposes during which there is used a loading mass having an appropriate viscosity. By suitable apparatus such as squeeze rolls or doctor blades the desired amount of coating is applied and consequently the desired total weight of the shoe inner material is obtained (in grams per square meter of surface area).

Preferably the drying takes place on heated drying rolls arranged in succession or in drying conduits or in drying ovens, through which the continuously running sheet is conducted by known means.

The application of the adhesive layer on one side of the loaded or coated continuous sheet also can be carried out besides as described above by melting, spraying, knife coating or dusting whereby the synthetic resin must have the necessary form of consistence for each of the stated process variants as for example the form of a powdery granulate or a paste (dispersion).

To improve the surface of the continuous sheet this can be smoothed by using heated rolls, by pressure, heat and the like known processes or preferably can be finished by a mechanical treatment such as for example buffing. Through the buffing (with buffing paper or sand paper) it receives advantageously a particular uniform, velvet like surface.

The new shoe inner material subsequent to the production in continuous length is cut into sheets of for example one by one meter size or in suitable blanks. The shoe producers mostly prefer to produce the blank itself from said sheets, for example by means of a cutting die to make a blank according to the non-slip model or size.

Frequently these cut-pieces or blanks are not skived, this means using blanks without having removed their edges by skiving. The ability of the material to be skived without problem is an important advantage, because the skived blanks or shapes improve the appearance and the wearability of the shoe. The skiving of the edges is performed either only on the upper line or also on the sides of the blanks which is subsequently sewn onto the upper, i.e. either only on the upper line or also on the sides. In the production of lined shoes the material according to the invention can be bound by sewing or gluing with the lining, too.

Now the preforming is done with a so-called preform machine and simultaneously there is performed the adhesion by the heated mold, the adhesive used being activated by the heat involved. If preform machines are not available the shaping according to the last can be carried out also by brushing on the blank with one of the above mentioned organic solvents or a mixture of solvents by which the blank becomes soft and flexible, and subsequently shaping is done.

The remaining operations on the shoe are as is customary.

The finished shoe with the new shoe inner material is distinguished by a line according to the last resulting in a slim counter form. The valuable advantage is that in place of the customary three layers (upper material, counter and non-slips only two layers (upper material and the new shoe inner material) form the heel region of the shoe.

Unless otherwise indicated all parts and percentages are by weight. The compositions can comprise, consist essentially of, or consist of the materials set forth and the process can comprise, consist essentially of or consist of the steps set forth.

DESCRIPTION OF THE PREFERRED EMBODIMENTS

There were produced the following mixtures as loading compositions for the later coating, steeping or impregnating of a fiber structure. For this purpose the individual components of the mixture were mixed together in the stated sequence under slow stirring and further stirred at room temperature until complete homogeneity.

The parts (for short P) given below are always by weight.

I 1. 75.0 P of an aqueous dispersion of a homopolymer of styrene containing 50 weight percent dry material (solids) and a pH of 11.5; the styrene polymerizate itself had a softening temperature of about 105° C. and formed a closed film at 185° C. (film forming temperature), 2. 23.0 P of an aqueous, colloidal dispersion of poly-2-chlorobutadiene containing 58 weight percent of polymer and a pH of 13.0; the poly-2-chlorobutadiene itself is a type having only a slight tendency toward crystallization and in the dispersion has an average particle size of about 160 microns.

3. 2.0 P of a plasticizer-emulsifier mixture of 60.0 P dibutyl phthalate, 5.0 P of a commercial emulsifier (OFA-emulsifier of Chemische Werke Hüls A.G. in Marl, Germany) and 4. 35.0 P water.

II 1. 85.0 P of an aqueous dispersion of a carboxylated styrene-butadiene copolymer with 50 weight percent dry material and a pH of 8.0 to 9.0 produced from a copolymer containing 81% styrene (Dow Latex 210 of Dow Chemical S.A. Europe in Zurich, Switzerland) and 2. 15.0 P of a natural, crystalline, finely ground calcium carbonate.

III 1. 14.0 P of an aqueous dispersion of a carboxylated styrene-butadiene-copolymer (same dispersion as under II, 1.).

2. 50.0 P of an aqueous dispersion of a carboxylated styrene-butadiene copolymer containing 48 weight percent of dry material and a pH of 8.0 to 9.0 produced from a copolymer containing 63% of butadiene (Synthomer Latex 9340 of Synthomer Chemie GmbH, Franfurt am Main, Germany), 3. 5.8 P of a water containing precondensate of urea and formaldehyde (Urecoll® 181 of BASF A.G. in Ludwigshafen, Germany), with a viscosity of 5 to 8 Pa s (viscosity determination according to DIN 53015 (German Industrial Standard 53015) in a 4% aqueous solution), containing 70 weight percent dry material, a density of 1.3 and a pH of 8.0 to 9.0 wherein the precondensate (as dry material) has a nitrogen content of 18 to 19 weight percent, 4. 1.2 P ammonium chloride and 5. 29.0 P of a natural, crystalline, finely ground calcium carbonate (same product as under II, 2.)

(a) The loading composition according to I was now applied to a continuous fleece with help of an impregnating apparatus (from impregnating tank with composition I and an immersed return guide roll as well as a dosing pair of rolls at the edge of the tank). This fleece was a customary endless fiber fleece of 3.5 dtex size fibers of poly ethylene glycol terephthalate held together by known binders and had a weight of about 180 g/m$^2$. The loaded fleece was then dried until constant weight at an increasing temperature up to about 130° C. and subsequently brought to a thickness of about 1.5 mm with help of conventional calender rolls. The total weight of the finished goods was 750 g/m$^2$, which corresponds to a loading of 570 g/m$^2$.

The goods had a pleasant homogeneous appearance visible over the entire surface and the desired feel which was found to be slip and skid resistant and felt somewhat napped or of good hand.

About half the entire metric (i.e. the footage) of this goods was now buffed on one of the large surface sides with the help of a conventional grinder or roll buffing apparatus whose buffing rolls were coated with an abrasive-coated paper having a 120 mesh grain.

Through this the buffed surface of the good receive a pleasant, velvet like character. These goods are suitably so used that the buffed side, later worked into the shoe is turned to the heel or the hose.

(b) The loading composition according to II was applied with a conventional brushing machine one a web of the following type and composition: staple fiber-crosshead, both sides napped; weight about 250 g/m$^2$; fiber density 27/19 fibers per cm. Count of yarn Nm=28/14. The loading was 500 g/m$^2$. Final weight of the finished goods 750 g/m$^2$; thickness 0.90 mm. It was especially suited as stiffener and at the same time non-slip material for shoes.

(c) The loading composition III was applied on a cotton fabric napped on both sides (weight 250 g/m$^2$; fiber density 17/15 fibers per cm. Count of yarn Nm=34/8 calico construction) with a conventional coating machine. After the drying and calendering the goods weighed 780 g/m$^2$, had a thickness of 1 mm and is very well suited for stiffening the rear caps of shoes.

(d) To apply color to the loadening composition III a mixture of pigments was mixed into it, i.e. per 100 kg of loading composition 140 grams brown, 120 grams yellow and 19 grams black (Volcanosol® pigments of BASF A.G. in Ludwigshafen, Germany) and the finished composition applied on the above described endless fiber fleece in such an amount that the loaded, dry goods then weighed 750 g/m$^2$. The calendering gave a goods thickness of around 1.1 mm. As was described under (a) the goods were then buffed on one side whereby its appearance became uniform and its feel was less rough.

For the working into the shoe there were now cutted out pieces from the continuous length cut into size and these skived on one side. The pieces, worked into the heel region of the shoe gave this a permanent, last accurate heel shape and simultaneously there was prevented the easy slipping out of the heel part of the shoe.

(e) The shoe inner material described above under (a) with a surface buffed on one side was provided on the other side with an adhesive layer of the following composition:

(1) 22.0 P of an ethylene-vinyl acetate copolymer (containing 40% vinyl acetate; melt index 2–5 [grams per 10 minutes at 190° C. and 2.16 kp load]; Mooney-viscosity ML4=20).

(2) 16.5 P of a terpene-phenol resin (melting range 120°–130° C.; acid number 60–70, determined as milligrams KOH per grams solid resin), (3) 16.5 P of a maleinate resin (melting range 108°–118° C., acid number 120, determined in the manner stated above) and (4) 45.0 P of toluene as solvent for (1) and (3).

The toluene solution was applied to a continuous length of the loaded fleece with help of a conventional blanket coater with a doctor knife and dried on a subsequent tenter. After evaporating the toluene there was ascertained an increase of weight of the continuous length of material of around 100 grams per square meter.

The dry adhesive coat is easily brought again into the adhesive condition by the action of heat or through solvents. In the further processing together with this activation of the adhesive the cutted and skived piece becomes pliable and moldable and is molded on the last. This implies an advantageous simplification of the process.

There is hereby incorporated by reference the priority German applications Nos. P 28 28 509.8 and G 78 19 462.4.

What is claimed is:

1. Stiffing and non-slip shoe inner material suitable for the heel region of a shoe which material is thermoplastic or moldable through the action of solvent and in the form of continuous sheets or blanks, said material comprising a single fiber structure loaded with at least one synthetic resin acting as a stiffening agent at a temperature up to 60° C. in an amount of 0.1 to 0.9 kg per square meter of fiber structure and wherein at least one surface of the shoe inner material is slip or skid preventive.

2. A stiffening and non-slip shoe inner material according to claim 1 including at least one member of the group consisting of fillers, dyestuffs, pigments, plasticizers, propellants, stabilizers, process aids and extenders.

3. A heel region of a shoe consisting of two layers, one layer being the shoe inner material of claim 1 and the other layer being the upper securely adhered thereto.

4. A shoe inner material according to claim 1 wherein only one surface of the shoe inner material is slip or skid preventive.

5. A shoe inner material according to claim 1 wherein both surfaces of the shoe inner material are slip or skid preventive.

6. A shoe inner material according to claim 1 having on one of the large surface sides of the continuous sheet or blank a coat of a synthetic resin capable of being brought into the adhesive condition by the effect of heat or a solvent.

7. A shoe having in the heel region securely adhered to the leg thereof as stiffener the stiffening material of claim 6.

8. A shoe according to claim 7 wherein the synthetic resin acts as a stiffening agent at a temperature of 15° to 60° C.

9. A shoe inner material according to claim 6 wherein the synthetic resin acts as a stiffening agent at a temperature of 15° to 60° C.

10. A shoe inner material according to claim 6 wherein the side of the material which does not have a coating of the layer capable of becoming adhesive has a velvet like surface character.

11. A shoe having in the heel region securely adhered to the leg thereof as stiffener the stiffening material of claim 10.

12. A shoe according to claim 11 wherein the synthetic resin acts as a stiffening agent at a temperature of 15° to 60° C.

13. A shoe inner material according to claim 10 wherein the synthetic resin acts as a stiffening agent at a temperature of 15° to 60° C.

14. A shoe inner material according to claim 10 wherein the synthetic resin of the loading is a polymer of styrene, a copolymer of styrene and butadiene, polyvinyl chloride, polyvinyl acetate, polyvinylidene chloride or vinyl chloride-vinyl acetate copolymer.

15. A shoe having in the heel region securely adhered to the leg thereof as stiffener the stiffening material of claim 14.

16. A shoe according to claim 15 wherein the synthetic resin acts as a stiffening agent at a temperature of 15° to 60° C.

17. A shoe inner material according to claim 14 wherein the synthetic resin acts as a stiffening agent at a temperature of 15° to 60° C.

18. A shoe inner material according to claim 14 wherein the loading is in an amount of 0.2 to 0.7 kg per square meter of fiber structure.

19. A shoe inner material according to claim 18 wherein the loading is a polymer or a copolymer of styrene and butadiene having a styrene content between about 85 and 60 or between 40 and 20 weight percent.

20. A shoe having in the heel region securely adhered to the leg thereof as stiffener the stiffening material of claim 19.

21. A shoe according to claim 20 wherein the synthetic resin acts as a stiffening agent at a temperature of 15° to 60° C.

22. A shoe inner material according to claim 19 wherein the synthetic resin acts as a stiffening agent at a temperature of 15° to 60° C.

23. A shoe inner material according to claim 19 wherein the loading is a carboxylated styrene-butadiene copolymer.

24. A shoe having in the heel region securely adhered to the leg thereof as stiffener the stiffening material of claim 23.

25. A shoe inner material according to claim 6 wherein the synthetic resin of the loading is a polymer of styrene, a copolymer of styrene and butadiene, polyvinyl chloride, polyvinyl acetate, polyvinylidene chloride or vinyl chloride-vinyl acetate copolymer.

26. A shoe having in the heel region securely adhered to the leg thereof as stiffener the stiffening material of claim 25.

27. A shoe according to claim 26 wherein the synthetic resin acts as a stiffening agent at a temperature of 15° to 60° C.

28. A shoe inner material according to claim 25 wherein the loading is a polymer or a copolymer of styrene and butadiene having a styrene content between about 85 and 60 or between 40 and 20 weight percent.

29. A shoe having in the heel region securely adhered to the leg thereof as stiffener the stiffening material of claim 28.

30. A shoe according to claim 29 wherein the synthetic resin acts as a stiffening agent at a temperature of 15° to 60° C.

31. A shoe inner material according to claim 28 wherein the synthetic resin acts as a stiffening agent at a temperature of 15° to 60° C.

32. A shoe inner material according to claim 28 wherein the loading is a carboxylated styrene-butadiene copolymer.

33. A shoe having in the heel region securely adhered to the leg thereof as stiffener the stiffening material of claim 32.

34. A shoe inner material according to claim 1 wherein the synthetic resin of the loading is at least one member of the group consisting of a polymer of styrene, a copolymer of styrene and butadiene, polyvinyl chloride, polyvinyl acetate, polyvinylidene chloride and vinyl chloride vinyl-acetate copolymer.

35. A shoe having in the heel region securely adhered to the leg thereof as stiffener the stiffening material of claim 34.

36. A shoe inner material according to claim 34 wherein the synthetic resin acts as a stiffening agent at a temperature of 15° to 60° C.

37. A shoe inner material according to claim 34 wherein the loading is a polymer or a copolymer of styrene and butadiene having a styrene content between about 85 and 60 or between 40 and 20 weight percent.

38. A shoe inner material according to claim 37 wherein the synthetic resin acts as a stiffening agent at a temperature of 15° to 60° C.

39. A shoe having in the heel region securely adhered to the leg or upper thereof as stiffener the stiffening material of claim 37.

40. A shoe inner material according to claim 39 wherein the synthetic resin acts as a stiffening agent at a temperature of 15° to 60° C.

41. A shoe having in the heel region securely adhered to the leg thereof as stiffener the stiffening material of claim 1.

42. A shoe according to claim 41 wherein the synthetic resin acts as a stiffening agent at a temperature of 15° to 60° C.

43. A shoe having a heel region made by a process for stiffening the heel region thereof, said process comprising simultaneously stiffening the heel region and producing the non-slip effect by adhesively joining a blank of the formable shoe inner material which is thermoplastic and in the form of continuous sheets or blanks, said material comprising a single fiber structure loaded with at least one synthetic resin acting as a stiffening agent at a temperature up to 60° C. in an amount of 0.1 to 0.9 kg per square meter of fiber structure and wherein at least one surface of the shoe inner material is slip or skid preventive.

44. A shoe inner material according to claim 1 wherein the synthetic resin acts as a stiffening agent at a temperature of 15° to 60° C.

45. A heel region of a shoe consisting of two layers, one layer being the shoe inner material of claim 44 and the other layer being the upper securely adhered thereto.

46. A shoe inner material according to claim 25 wherein the synthetic resin acts as a stiffening agent at a temperature of 15° to 60° C.

47. A shoe according to claim 35 wherein the synthetic resin acts as a stiffening agent at a temperature of 15° to 60° C.

48. A heel region of a shoe consisting of two layers, one layer being the shoe inner material of claim 10 and the other layer being the upper securely adhered thereto.

49. A heel region of a shoe consisting of two layers, one layer being the shoe inner material of claim 19 and the other layer being the upper securely adhered thereto.

50. A heel region of a shoe consisting of two layers, one layer being the shoe inner material of claim 23 and the other layer being the upper securely adhered thereto.

* * * * *